US011662085B1

(12) United States Patent
Guo

(10) Patent No.: US 11,662,085 B1
(45) Date of Patent: May 30, 2023

(54) LAMP AND LAMP FIXING DEVICE

(71) Applicant: Kexian Guo, Shenzhen (CN)

(72) Inventor: Kexian Guo, Shenzhen (CN)

( * ) Notice: Subject to any disclaimer, the term of this patent is extended or adjusted under 35 U.S.C. 154(b) by 0 days.

(21) Appl. No.: 18/089,915

(22) Filed: Dec. 28, 2022

(51) Int. Cl.
*F21V 21/088* (2006.01)
*F21V 17/16* (2006.01)

(52) U.S. Cl.
CPC ..... *F21V 21/088* (2013.01); *F21V 17/16* (2013.01)

(58) Field of Classification Search
CPC .... F21V 21/0885; F21V 21/088; F21V 17/16; F21V 17/162; F21V 17/166; F21V 17/168
USPC ..... 362/249.11, 249.16, 249.01, 249.15, 396
See application file for complete search history.

(56) References Cited

U.S. PATENT DOCUMENTS 1,954,756 A * 4/1934 Kidston ..... F21S 6/001 362/396
2003/0227773 A1* 12/2003 Yang ..... B62J 6/029 362/199

FOREIGN PATENT DOCUMENTS

CN 215112172 U * 12/2021 ..... F21S 6/003

OTHER PUBLICATIONS

Computer translation of CN215112172; 5 pages (Year: 2021).*

* cited by examiner

*Primary Examiner* — Lau K Tso
(74) *Attorney, Agent, or Firm* — Daniel M. Cohn; Howard M. Cohn

(57) ABSTRACT

A lamp and a lamp fixing device are provided. The lamp includes a lamp body and a clamping mechanism. The lamp body is connected to the clamping mechanism. The clamping mechanism includes a first clamping plate, a second clamping plate, and an elastic component. The first clamping plate includes a first pressing portion and a first clamping portion, and the first pressing portion is connected with the first clamping portion. The second clamping plate is hinged to the first clamping plate. The second clamping plate includes a second pressing portion and a second clamping portion. The second pressing portion is connected with the second clamping portion. The elastic component is disposed between the first pressing portion and the second pressing portion, so that the first clamping portion is close to the second clamping portion. The first clamping portion includes a connecting structure and a turning sheet.

20 Claims, 12 Drawing Sheets

LAMP AND LAMP FIXING DEVICE

TECHNICAL FIELD

The present disclosure relates to a technical field of home furnishing, and in particular to a lamp and a lamp fixing device.

BACKGROUND

Electrical lighting system is configured to provide one or more light emitting devices for achieving at least one of illumination effect and aesthetic effect. The electrical lighting system improves area appearance and provides positive psychological effects for people. Most decorative electrical lighting systems include one or more lamp holders, each of the one or more lamp holders includes a light emitting device, which is operable and is disposed in the respective lamp hold, such as a Christmas lamp, a Halloween lamp, a yard lamp, or other decorative festival lamps. However, reliably attaching such lamps to and removing such lamps from environmental objects, such as trees, ornamental shrubs, eaves, or other objects, are particularly challenging tasks. Moreover, attaching such lamps at different positions is time-consuming, and most of the positions are inconvenient for the lamps to attach, which further increases working difficulty and working time.

SUMMARY

The present disclosure provides a lamp, which is convenient for installing the lamp and stably installing the lamp on an object to-be-clamped.

In a first aspect, the present disclosure provides the lamp, including at least one lamp body and at least one clamping mechanism. The at least one lamp body is connected to the at least one clamping mechanism. The clamping mechanism includes a first clamping plate, a second clamping plate, and an elastic component.

The first clamping plate includes a first pressing portion and a first clamping portion, and the first pressing portion is connected with the first clamping portion.

The second clamping plate is hinged to the first clamping plate. The second clamping plate includes a second pressing portion and a second clamping portion. The second pressing portion is connected with the second clamping portion.

The elastic component is disposed between the first pressing portion and the second pressing portion, so that the first clamping portion is close to the second clamping portion.

The first clamping portion includes a connecting structure and a turning sheet. The connecting structure is connected to the first pressing portion. The turning sheet is rotatably connected to the connecting structure. The turning sheet and the second clamping portion are configured to clamp objects to-be-clamped.

Optionally, a rotating shaft is disposed at one end, distal from the first pressing portion, of the connecting structure. The turning sheet includes a clamping slot. The rotating shaft is clamped in the clamping slot, so that the turning sheet rotates around the rotating shaft.

Optionally, the clamping slot includes a first opening. The rotating shaft is clamped in the clamping slot through the first opening. A size of the first opening is smaller than a diameter of the rotating shaft.

Optionally, the turning sheet includes a first clamping side. The first clamping side is clamped and matched with the second clamping portion. A first anti-skid structure is disposed on the first clamping side.

Optionally, the first anti-skid structure includes a plurality of anti-skid strips. The plurality of the anti-skid strips are uniformly distributed on the first clamping side.

Optionally, the second clamping portion includes a second clamping side facing the first clamping portion. A second anti-skid structure is disposed on the second clamping side.

Optionally, the second clamping side includes an end edge distal from the second pressing portion and two side edges connected with the end edge. The two side edges are oppositely disposed and are connected to two ends of the end edge. The second anti-skid structure is disposed on the end edge and the two side edges.

Optionally, the lamp further includes at least one fixing mechanism. The at least one fixing mechanism is connected to the at least one clamping mechanism. The at least one fixing mechanism includes a clamping portion. The at least one lamp body is clamped to the clamping portion.

Optionally, the clamping portion is rotatably connected to the at least one clamping mechanism. The clamping portion is fixedly kept at different angles with the at least one clamping mechanism.

Optionally, two protruding portions are disposed on one side, facing the at least one fixing mechanism, of the at least one clamping mechanism. The two protruding portions are disposed at intervals. Clamping grooves are defined on the two protruding portions. A positioning portion is disposed in an area, located between the two protruding portions, of the at least one clamping mechanism.

The at least one fixing mechanism includes a gear. Convex columns are respectively disposed on two opposite side edges of the gear. Each of the convex columns is clamped in a respective one of the clamping grooves. The gear is matched with the positioning portion to be positioned at different angles.

Optionally, the clamping portion includes a hollow accommodating space. The clamping portion includes an annular wall. The annular wall surrounds to form the hollow accommodating space. A second opening is defined on one side of the annular wall. The second opening is communicated with the hollow accommodating space. The at least one lamp body enters the hollow accommodating space through the second opening. The at least one lamp body is clamped to the annular wall.

Optionally, the at least one lamp body includes a main body portion and a hook. The main body portion is connected with the hook. The main body portion is disposed in the hollow accommodating space. The hook is hung on the annular wall.

Optionally, the fixing mechanism further includes a wire accommodating groove. The wire accommodating groove is configured to contain a wire connected to the lamp body.

Optionally, the wire accommodating groove is defined between the clamping portion and the at least one clamping mechanism.

Optionally, the clamping portion includes a first clamping arm and a second clamping arm. The first clamping arm and the second clamping arm are oppositely disposed. The first clamping arm includes a first arc-shaped structure. The first arc-shaped structure is bent along a direction distal from the second clamping arm. The second clamping arm includes a second arc-shaped structure. The second arc-shaped structure is bent along a direction distal from the first clamping arm. The first arc-shaped structure and the second arc-shaped structure surround to form a first clamping space.

Optionally, the first clamping arm further includes a third arc-shaped structure. The third arc-shaped structure is bent along a direction distal from the second clamping arm. The second clamping arm includes a fourth arc-shaped structure. The fourth arc-shaped structure is bent along a direction distal from the first clamping arm. The third arc-shaped structure and the fourth arc-shaped structure surround to form a second clamping space. The second clamping space is smaller than the first clamping space.

Optionally, a first end, close to the at least one clamping mechanism, of the first clamping arm is connected to a first end, close to the at least one clamping mechanism, of the second clamping arm. A second end, distal from the at least one clamping mechanism, of the first clamping arm is separated from a second end, distal from the clamping mechanism, of the second clamping arm.

Optionally, the lamp includes a plurality of the lamp bodies, a plurality of the clamping mechanisms, and a plurality of the fixing mechanisms. The plurality of the lamp bodies are connected through wires. The plurality of the clamping mechanisms and the plurality of the fixing mechanisms are disposed in one-to-one correspondence. Each of the plurality of the lamp bodies is disposed on one of the plurality of the fixing mechanisms.

In a second aspect, the present disclosure provides a lamp fixing device, including: a clamping mechanism and a fixing mechanism. The clamping mechanism is connected with the fixing mechanism. The fixing mechanism is configured to install a lamp body. The clamping mechanism includes: a first clamping plate, a second clamping plate, and an elastic component.

The first clamping plate includes a first pressing portion and a first clamping portion. The first pressing portion is connected with the first clamping portion.

The second clamping plate is hinged to the first clamping plate. The second clamping plate includes a second pressing portion and a second clamping portion. The second pressing portion is connected with the second clamping portion.

The elastic component is disposed between the first pressing portion and the second pressing portion, so that the first clamping portion is close to the second clamping portion.

The first clamping portion includes a connecting structure and a turning sheet. The connecting structure is connected to the first pressing portion. The turning sheet is rotatably connected to the connecting structure. The turning sheet and the second clamping portion are configured to clamp objects to-be-clamped.

Optionally, the fixing mechanism includes a clamping portion. The lamp body is clamped to the clamping portion. The clamping portion is rotatably connected to the clamping mechanism and is fixedly kept at different angles with the clamping mechanism.

In embodiments of the present disclosure, the lamp body is connected to the clamping mechanism. The clamping mechanism includes the first clamping plate, the second clamping plate, and the elastic component, which are mutually matched, so that the clamping mechanism is conveniently clamped on other structures. The first clamping portion of the first clamping plate includes the connecting structure and the turning sheet. The turning sheet rotates with respect to the connecting structure, and the turning sheet and the second clamping portion are configured to clamp the objects to-be-clamped. According to different application scenes, corresponding to the different objects to-be-clamped, the turning sheet rotates with respect to the connecting structure to clamp the objects to-be-clamped with different thicknesses. The turning sheet further automatically adjusts and keeps level of the objects to-be-clamped, which increases contact surface and friction, and improves clamping stability. For example, if the to-be-clamped object is an uneven wood board, and two opposite sides of the wood board are not disposed in parallel, then the first clamping portion abuts against a first side of the wood board, and the turning sheet of the second clamping portion rotates to abut against a second side of the wood board. The contact surface between the first clamping portion and the first side of the wood board is large, and the contact surface of the turning sheet and the second side of the wood board is further large, so that the clamping mechanism stably clamps the wood board.

BRIEF DESCRIPTION OF DRAWINGS

In order to more clearly illustrate technical solutions in embodiments of the present disclosure, drawings that need to be used in description of the embodiments are briefly described below. In an obvious way, the drawings in the following description are merely some embodiments of the present disclosure, and for a person skilled in art, other drawings are obtained according to the drawings without involving any inventive effort.

For a more complete understanding of the present disclosure and beneficial effects thereof, the following description is made in conjunction with the accompanying drawings, in which like reference numerals refer to like portions in the following description.

Figure 1:
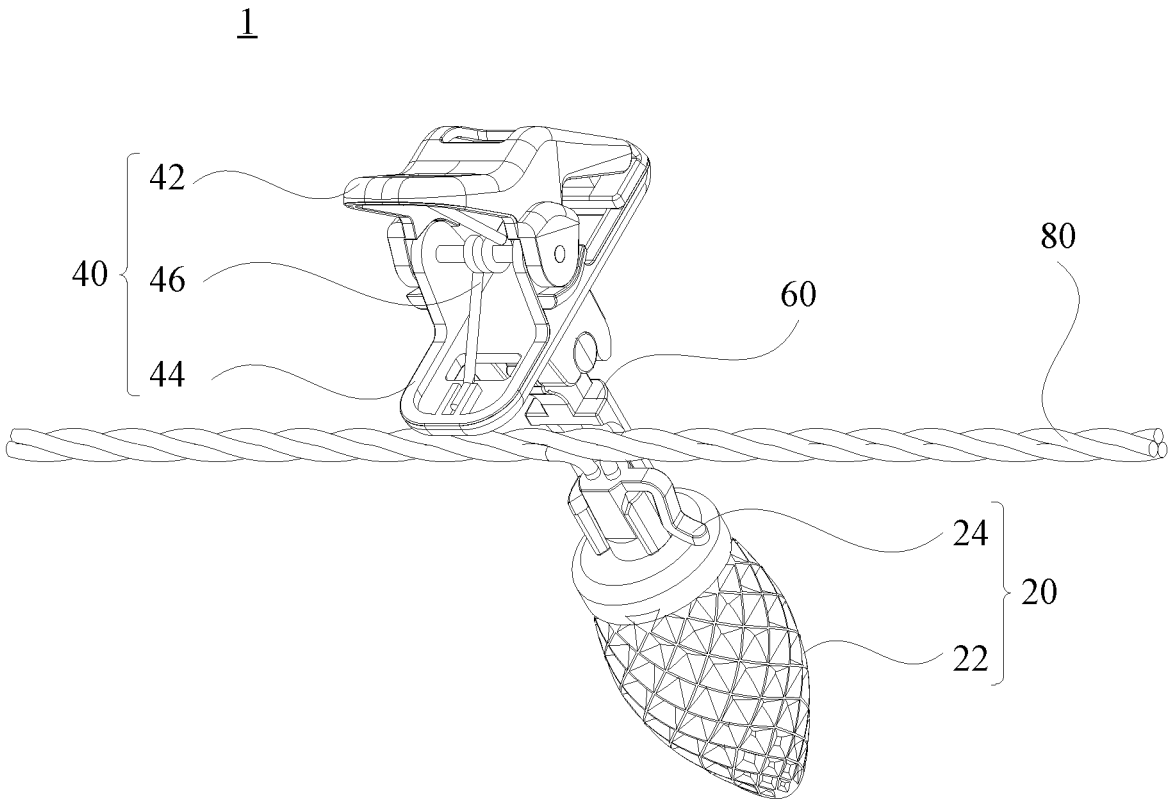
FIG. 1 is a first structural schematic diagram of a lamp according to one embodiment of the present disclosure.

Reference number in the drawings:

1. lamp;

20. lamp body; 22. main body portion; 24. hook;

40. clamping mechanism; 42. first clamping plate; 422. first pressing portion; 424. first clamping portion; 4242. connecting structure; 42422. rotating shaft; 42424. connecting arms; 4244. turning sheet; 42442. clamping slot; 42443. first opening; 42444. first clamping side; 42445. first anti-skid structure; 44. second clamping plate; 442. second pressing portion; 444. second clamping portion; 445. second clamping side; 4452. end edge; 4454. side edge; 446. second anti-skid structure; 46. elastic component; 47. protruding portion; 472. clamping groove; 48. positioning portion; 49. connecting shaft;

60. fixing mechanism; 62. clamping portion; 621. hollow accommodating space; 622. annular wall; 623. second opening; 624. first clamping arm; 6242. first arc-shaped structure; 6244. third arc-shaped structure; 6252. first clamping space; 6254. second clamping space; 626. second clamping arm; 6262. second arc-shaped structure; 6264. fourth arc-shaped structure; 64. gear; 642. convex column; 65. wire accommodating groove;

80. wire.

DETAILED DESCRIPTION

By combining drawings in embodiments of the present disclosure, technical solutions in the embodiments of the present disclosure are clearly and completely described. Obviously, the described embodiments are only a part of the embodiments of the present disclosure, rather than all the embodiments. On a basis of the embodiments of the present disclosure, all other embodiments obtained by a person skilled in art without involving any inventive effort belong to a protection scope of the present disclosure.

The present disclosure provides a lamp. Please refer to FIG. 1. FIG. 1 is a first structural schematic diagram of a lamp according to one embodiment of the present disclosure. The lamp 1 includes: a lamp body 20 and a clamping mechanism 40. The lamp body 20 is connected to the clamping mechanism 40. The clamping mechanism 40 includes a first clamping plate 42, a second clamping plate 44, and an elastic component 46.

Figure 2:
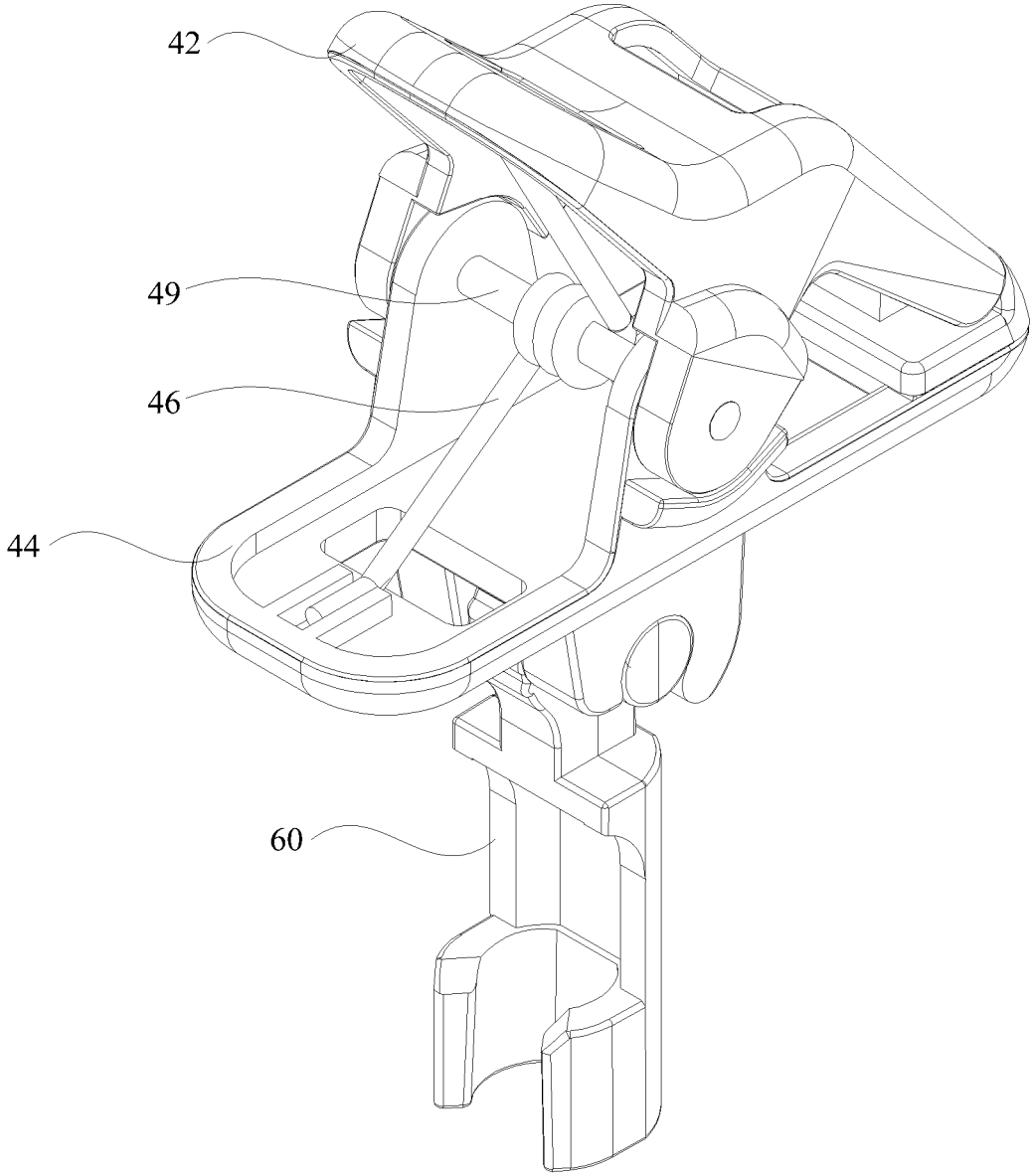
FIG. 2 is a structural schematic diagram of a clamping mechanism and a fixing mechanism in the lamp shown in FIG. 1.
Figure 3:
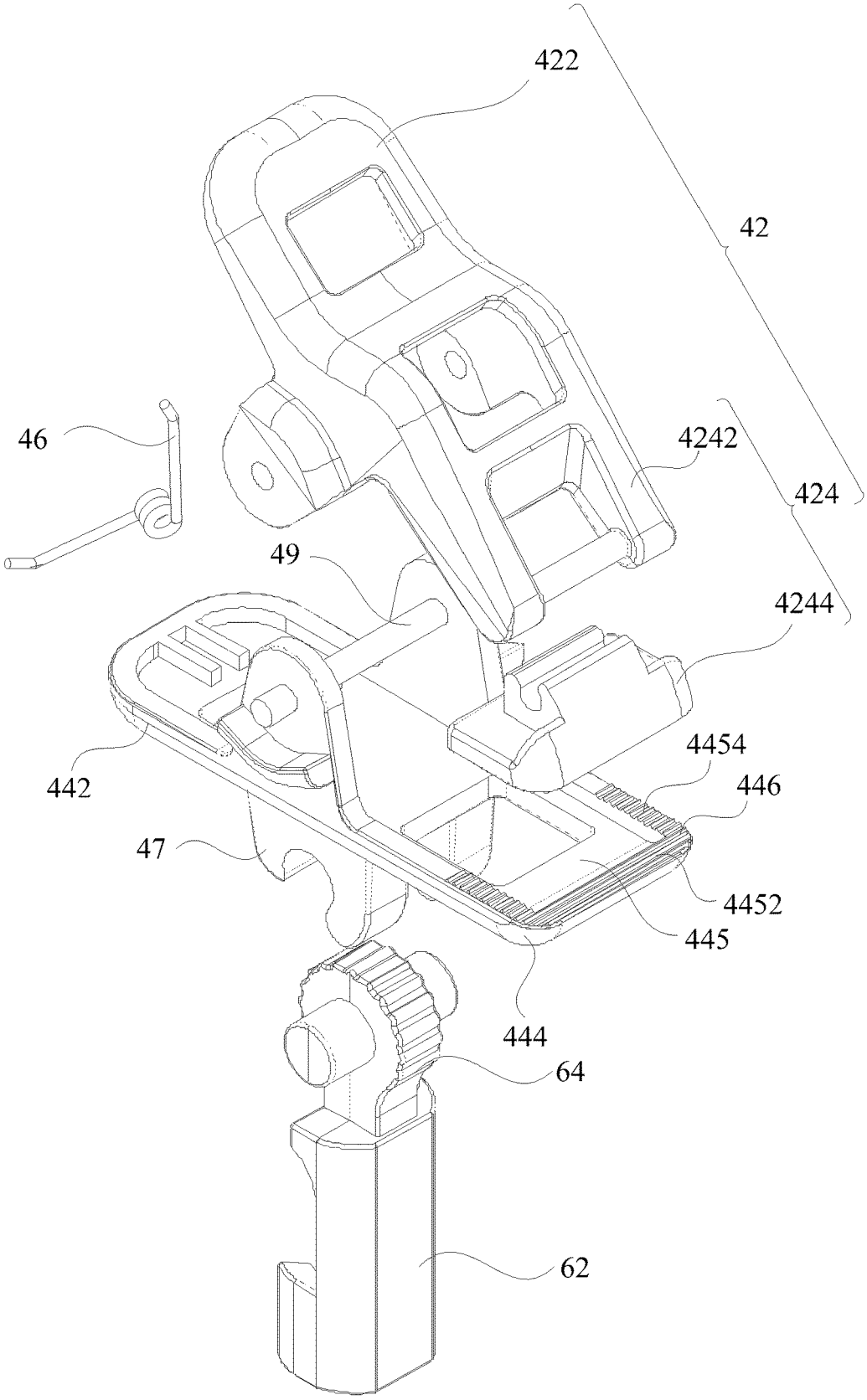
FIG. 3 is an exploded schematic diagram of the clamping mechanism and the fixing mechanism shown in FIG. 2.

Please refer to FIG. 2 and FIG. 3. FIG. 2 is a structural schematic diagram of a clamping mechanism and a fixing mechanism in the lamp shown in FIG. 1. FIG. 3 is an exploded schematic diagram of the clamping mechanism and the fixing mechanism shown in FIG. 2. The first clamping plate 42 includes a first pressing portion 422 and a first clamping portion 424, and the first pressing portion 422 is connected with the first clamping portion 424. The second clamping plate 44 is hinged to the first clamping plate 42. The second clamping plate 44 includes a second pressing portion 442 and a second clamping portion 444. The second pressing portion 442 is connected with the second clamping portion 444. The elastic component 46 is disposed between the first pressing portion 422 and the second pressing portion 442, so that the first clamping portion 424 is close to the second clamping portion 444.

The first clamping portion 424 includes a connecting structure 4242 and a turning sheet 4244. The connecting structure 4242 is connected to the first pressing portion 422. The turning sheet 4244 is rotatably connected to the connecting structure 4242. The turning sheet 4244 and the second clamping portion 444 are configured to clamp objects to-be-clamped.

The lamp body 20 is connected to the clamping mechanism 40. The clamping mechanism 40 includes the first clamping plate 42, the second clamping plate 44, and the elastic component 46, which are mutually matched, so that the clamping mechanism 40 is conveniently clamped on other structures, thereby installing the lamp body 20 on other structures. The first clamping portion 424 of the first clamping plate includes the connecting structure 4242 and the turning sheet 4244. The turning sheet 4244 rotates with respect to the connecting structure 4242, and the turning sheet 4244 and the second clamping portion 444 are configured to clamp the objects to-be-clamped. According to different application scenes, corresponding to the different objects to-be-clamped, the turning sheet 4244 rotates with respect to the connecting structure 4242 to clamp the objects to-be-clamped with different thicknesses. The turning sheet 4244 further automatically adjusts and keeps level of the objects to-be-clamped, which increases contact surface and friction, and improves firmness of the objects to-be-clamped. For example, if an object to-be-clamped is an uneven wood board, and two opposite sides of the wood board are not disposed in parallel, then the first clamping portion 424 abuts against a first side of the wood board, and the turning sheet 4244 of the second clamping portion 444 rotates to abut against a second side of the wood board. The contact surface between the first clamping portion 424 and the first side of the wood board is large, and the contact surface of the turning sheet 4244 and the second side of the wood board is further large, so that the clamping mechanism 40 stably clamps the wood board.

Figure 4:
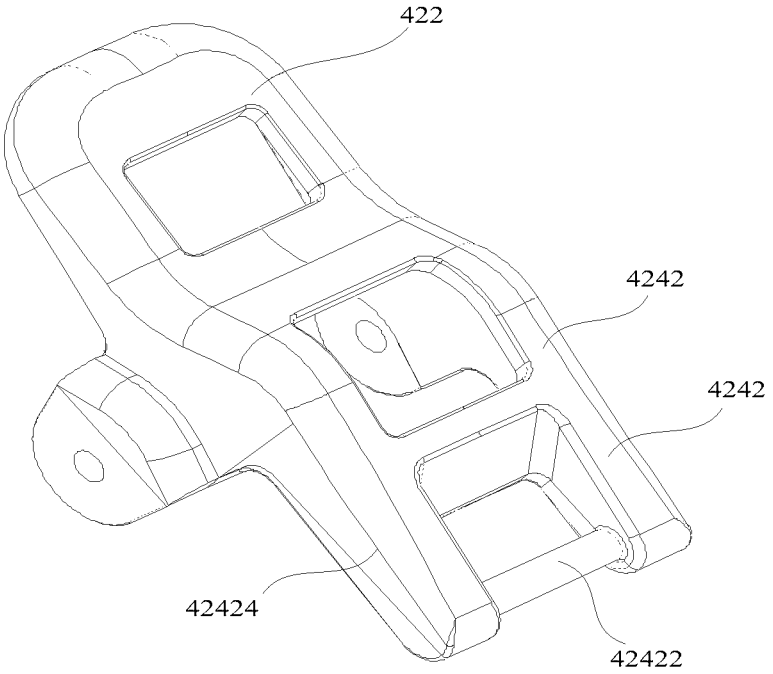
FIG. 4 is a structural schematic diagram of a connecting mechanism in the clamping mechanism and the fixing mechanism shown in FIG. 2.
Figure 5:
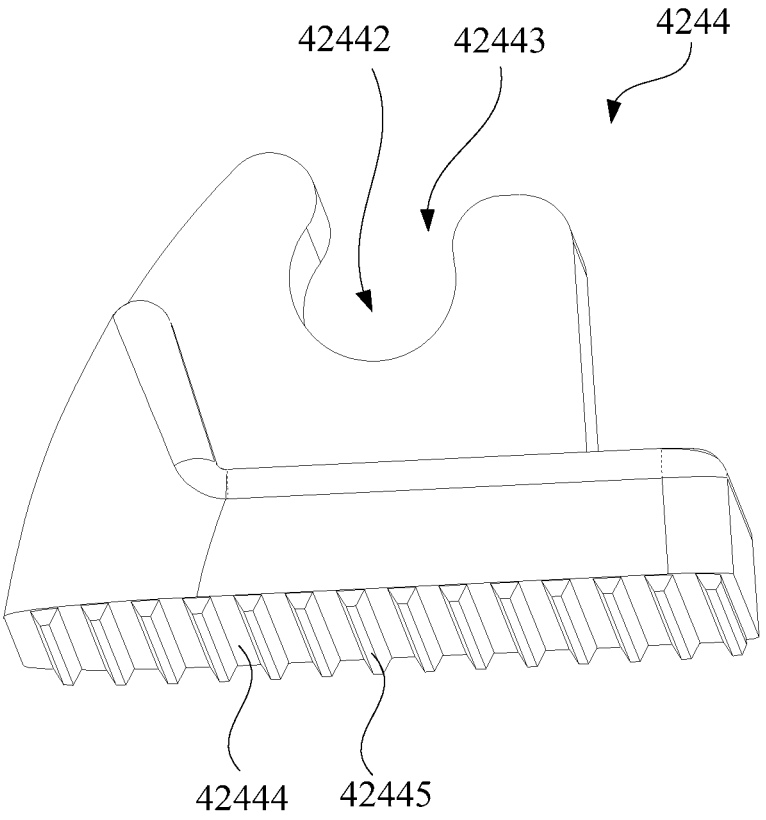
FIG. 5 is a structural schematic diagram of a turning sheet in the clamping mechanism and the fixing mechanism shown in FIG. 2.

Please refer to FIG. 4 and FIG. 5. FIG. 4 is a structural schematic diagram of a connecting mechanism in the clamping mechanism and the fixing mechanism shown in FIG. 2. FIG. 5 is a structural schematic diagram of a turning sheet in the clamping mechanism and the fixing mechanism shown in FIG. 2. A rotating shaft 42422 is disposed at one end, distal from the first pressing portion 422, of the connecting structure 4242. The turning sheet 4244 includes a clamping slot 42442. The rotating shaft 42422 is clamped in the clamping slot 42442, so that the turning sheet 4244 rotates around the rotating shaft 42422. The turning sheet 4244 and the connecting structure 4242 are rotatably connected through the clamping slot 42442 and the rotating shaft 42422, so that the turning sheet 4244 rotates relatively and conveniently.

It should be noted that two connecting arms 42424 are disposed at the end, distal from the first pressing portion 422, of the connecting structure 4242, and the two connecting arms 42424 are oppositely disposed. A hollow area is formed between the two connecting arms 42424. One end, distal from a first mounting portion, of each of the two connecting arms 42424 is connected to the rotating shaft 42422. That is, when the turning sheet 4244 rotates around the rotating shaft 42422, the connecting structure 4242 does not interfere with rotation of the turning sheet 4244.

Optionally, the clamping slot 42442 includes a first opening 42443. The rotating shaft is clamped in the clamping slot 42442 through the first opening 42443. A size of the first opening 42443 is smaller than a diameter of the rotating shaft. When the rotating shaft is clamped into the clamping slot 42442 through the first opening 42443, the first opening 42443 is expanded to enable the rotating shaft to pass through. After the rotating shaft is disposed in the clamping slot 42442, because a diameter of the rotating shaft is larger than a diameter of the first opening 42443, the rotating shaft does not easily leave the clamping slot 42442 from the first opening 42443.

In some other embodiments, the clamping slot is defined in the end, distal from the first pressing portion, of the connecting structure, the rotating shaft is disposed on the turning sheet, and the rotating shaft is clamped in the clamping slot, so that the turning sheet rotates around the rotating shaft.

Optionally, the turning sheet 4244 includes a first clamping side 42444. The first clamping side 42444 is clamped and matched with the second clamping portion 444. A first anti-skid structure 42445 is disposed on the first clamping side 42444, which improves the friction between the turning sheet 4244 and the objects to-be-clamped, and increases the firmness between the clamping mechanism 40 and the objects to-be-clamped.

Optionally, the second clamping portion 444 includes a second clamping side 445 facing the first clamping portion 424. A second anti-skid structure 446 is disposed on the second clamping side 445, which improves the friction between the second clamping portion 444 and the objects to-be-clamped, and increases the firmness between the clamping mechanism 40 and the objects to-be-clamped.

Optionally, the turning sheet 4244 includes a first clamping side 42444. The first clamping side 42444 is clamped and matched with the second clamping portion 444. A first anti-skid structure 42445 is disposed on the first clamping side 42444. The second clamping portion 444 includes a second clamping side 445 facing the first clamping portion 424. A second anti-skid structure 446 is disposed on the second clamping side 445. This structure improves the friction between the turning sheet 4244 and the objects to-be-clamped, improves the friction between the second clamping portion 444 and the objects to-be-clamped, and increases the firmness between the clamping mechanism 40 and the objects to-be-clamped.

The first anti-skid structure 42445 includes a plurality of anti-skid strips. The plurality of the anti-skid strips are uniformly distributed on the first clamping side 42444. The plurality of the anti-skid strips are paved with the first clamping side 42444, so that an anti-skid effect of the first clamping side 42444 is optimal. Of course, in some other embodiments, the first clamping side 42444 is further partially provided with the second anti-skid structure 446, such as disposing the second anti-skid structure 446 in a peripheral region or a middle region of the first clamping side 42444.

It is understood that the first anti-skid structure 42445 is further of a rough surface structure or has an anti-skid texture.

Please refer to FIG. 3. The second clamping side 445 includes an end edge 4452 distal from the second pressing portion 442 and two side edges 4454 connected with the end edge 4452. The two side edges 4454 are oppositely disposed and connected to two ends of the end edge 4452. The second anti-skid structure 446 is disposed on the end edge 4452 and the two side edges 4454. The second anti-skid structure 446 is only provided with a part of an area of the second clamping side 445, and the second clamping portion 444 is flexibly disposed. For example, a through hole is defined in a middle of the second clamping portion 444. Of course, in other embodiments, the second clamping side 445 is further laid up with the second anti-slip structure 446.

It is understood that the second anti-skid structure 446 includes a plurality of anti-skid strips, and the second anti-skid structure 446 is further a rough surface structure or has an anti-skid texture.

Optionally, the lamp 1 further includes a fixing mechanism 60. The fixing mechanism 60 is connected to the clamping mechanism 40. The fixing mechanism 60 includes a clamping portion 62. The lamp body 20 is clamped to the clamping portion 62. The lamp body 20 is clamped to the fixing mechanism 60 through the clamping portion 62. The lamp body 20 is quickly and conveniently disposed on the fixing mechanism 60.

It is understood that in some other embodiments, the lamp body is further disposed on the fixing mechanism in other modes, for example, the lamp body is disposed on the fixing mechanism in a threaded connection mode, a magnetic attraction mode, and the like.

The clamping portion 62 is rotatably connected to the clamping mechanism 40, and the clamping portion 62 is fixedly kept at different angles with the clamping mechanism 40. After the lamp body 20 is disposed on the fixing mechanism 60, an angle of the lamp body 20 and the fixing mechanism 60 corresponding to the clamping mechanism 40 is adjustable, and an illumination angle of the lamp body 20 and the fixing mechanism 60 is adjusted as required to meet different needs of users. For example, when the lamp 1 is disposed at edge of a room, adjusting the angle of the lamp body 20 and the fixing mechanism 60 corresponding to the clamping mechanism 40, so that light emitted by the lamp body 20 faces toward a middle of the room.

Figure 6:
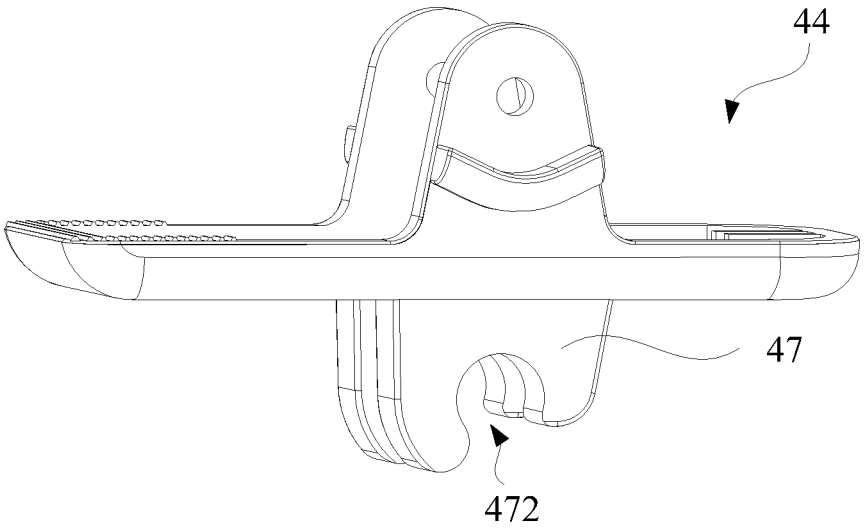
FIG. 6 is a structural schematic diagram of a second clamping plate in the clamping mechanism and the fixing mechanism shown in FIG. 2.
Figure 7:
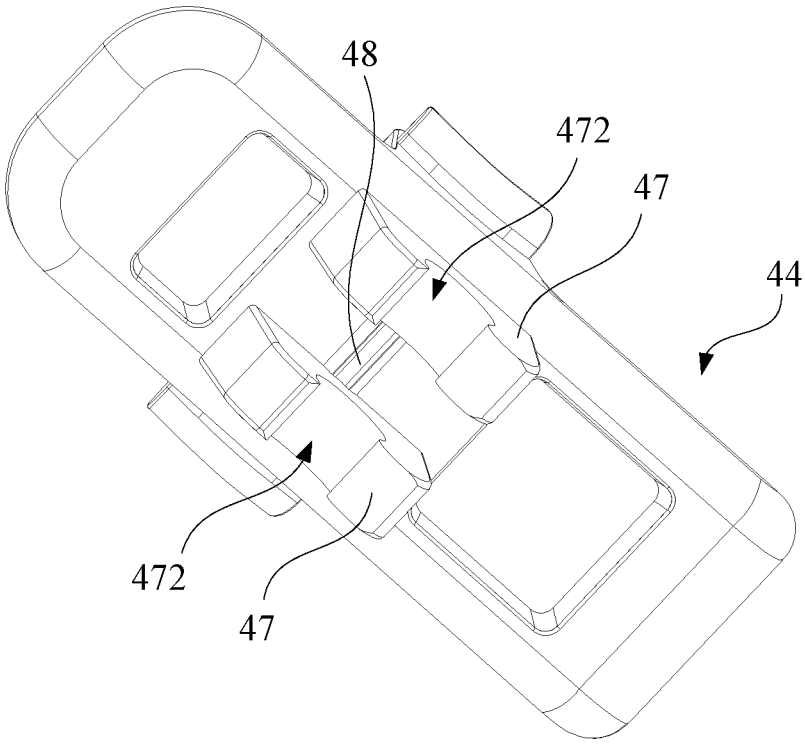
FIG. 7 is a structural schematic diagram of another angle of the second clamping plate shown in FIG. 6.

For example, please refer to FIG. 6 and FIG. 7. FIG. 6 is a structural schematic diagram of a second clamping plate in the clamping mechanism and the fixing mechanism shown in FIG. 2. FIG. 7 is a structural schematic diagram of another angle of the second clamping plate shown in FIG. 6. Two protruding portions 47 are disposed on one side, facing the fixing mechanism 60, of the clamping mechanism 40. The two protruding portions 47 are disposed at intervals. Clamping grooves 472 are defined on the two protruding portions 47. A positioning portion 48 is disposed in an area, located between the two protruding portions 47, of the clamping mechanism 40.

Figure 8:
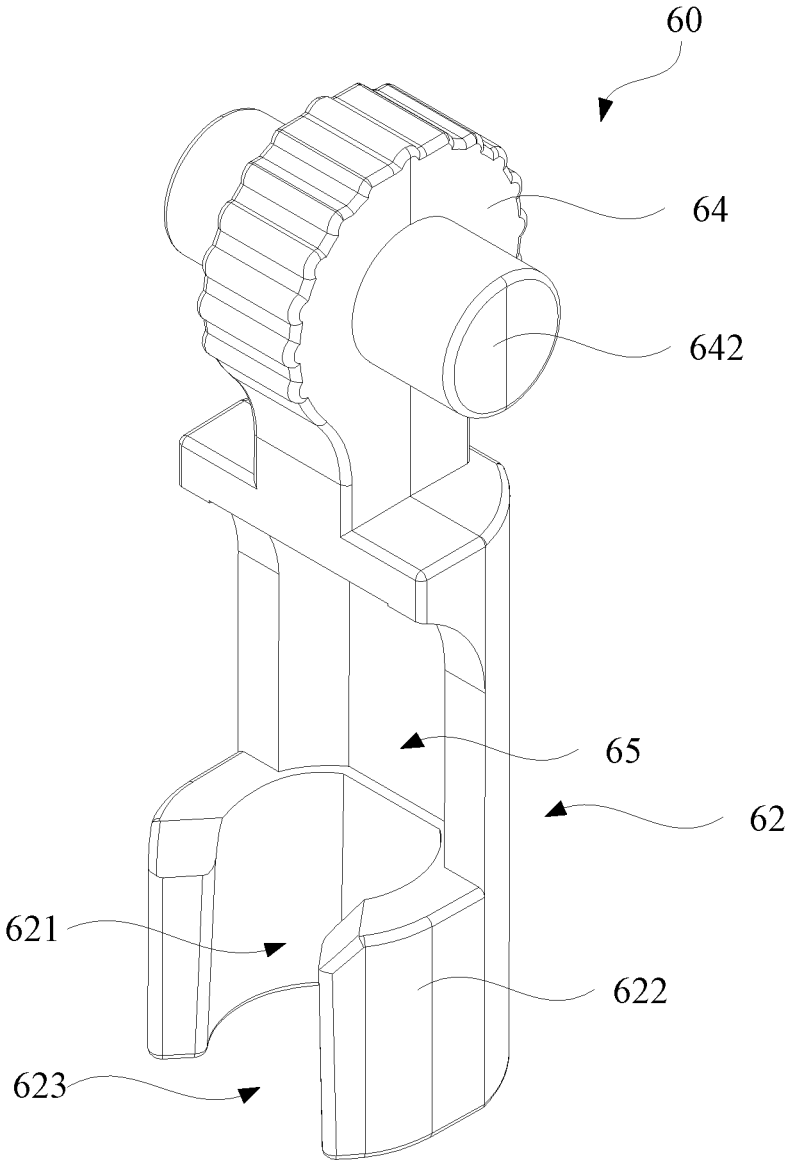
FIG. 8 is a structural schematic diagram of the fixing mechanism in the clamping mechanism and the fixing mechanism shown in FIG. 2.

Please refer to FIG. 8. FIG. 8 is a structural schematic diagram of the fixing mechanism in the clamping mechanism and the fixing mechanism shown in FIG. 2. The fixing mechanism 60 includes a gear 64. A convex column 642 is respectively disposed on each of two opposite side edges 4454 of the gear 64. Each convex column 642 is clamped in one of the clamping grooves 472, so that the fixing mechanism 60 and the clamping mechanism 40 are assembled, which is convenient to assemble. The gear 64 is matched with the positioning portion 48 to be positioned at different angles. Positioning of multiple angles is achieved through the gear 64 of the fixing mechanism 60 and the positioning portion 48 of the clamping mechanism 40. Specifically, a plurality of tooth structures are disposed on an outer side of the gear 64. When the gear 64 rotates with respect to the positioning portion 48, a blocking force is overcome to enable the plurality of the tooth structures at different positions of the gear 64 to be clamped to the positioning portion 48, so that the fixing mechanism 60 is at different angles with respect to the positioning portion 48, and the lamp body 20 is made to have different angles with respect to the fixing mechanism 60.

The clamping portion 62 includes a hollow accommodating space 621. The clamping portion 62 includes an annular wall 622. The annular wall 622 surrounds to form the hollow accommodating space 621. A second opening 623 is defined on one side of the annular wall 622. The second opening 623 is communicated with the hollow accommodating space 621. The lamp body 20 enters the hollow accommodating space 621 through the second opening 623. The lamp body 20 is clamped to the annular wall 622. The lamp body 20 is quickly clamped to the annular wall 622, so that the users conveniently and quickly install the lamp body 20 on the clamping portion 62.

For example, please continue to refer to FIG. 1. The lamp body 20 includes a main body portion 22 and a hook 24. The main body portion 22 is connected with the hook 24. The main body portion 22 is disposed in the hollow accommodating space 621. The hook 24 is hung on the annular wall 622. The main body portion 22 is a bulb or other light-emitting devices. A first side of the hook 24 is connected to the lamp body 20, and a second side of the hook 24 is hung on the annular wall 622, so that the main body portion 22 is hung on the annular wall 622.

Optionally, the fixing mechanism 60 further includes a wire accommodating groove 65. The wire accommodating groove 65 is configured to accommodate wires 80 connected to the lamp body 20. The lamp body 20 needs to be connected with a power supply through the wires 80. The wires 80 are disposed in the wire accommodating groove 65, so that the wires 80 are conveniently arranged.

The wire accommodating groove 65 is defined between the clamping portion 62 and the clamping mechanism 40. For example, the annular wall 622 encloses a semi-circular or large semi-circular structure. The annular wall 622 includes a top facing the clamping mechanism 40. The top includes a first portion and a second portion. The first portion is connected to the clamping mechanism 40 through the gear 64. The first portion is connected to the gear 64 through a connecting portion. The second portion is exposed. The second portion, the connecting portion, and the gear 64 form the wire accommodating groove 65. The second portion supports the wires 80. When a plurality of lamp bodies 20 are disposed on a plurality of fixing mechanisms 60, the wires 80 connected with the plurality of the lamp bodies 20 are disposed in the wire accommodating grooves 65 of the plurality of the fixing mechanisms 60, which store the wires 80 well, and the wires 80 do not appear cumbersome, thus having a high aesthetic.

Figure 9:
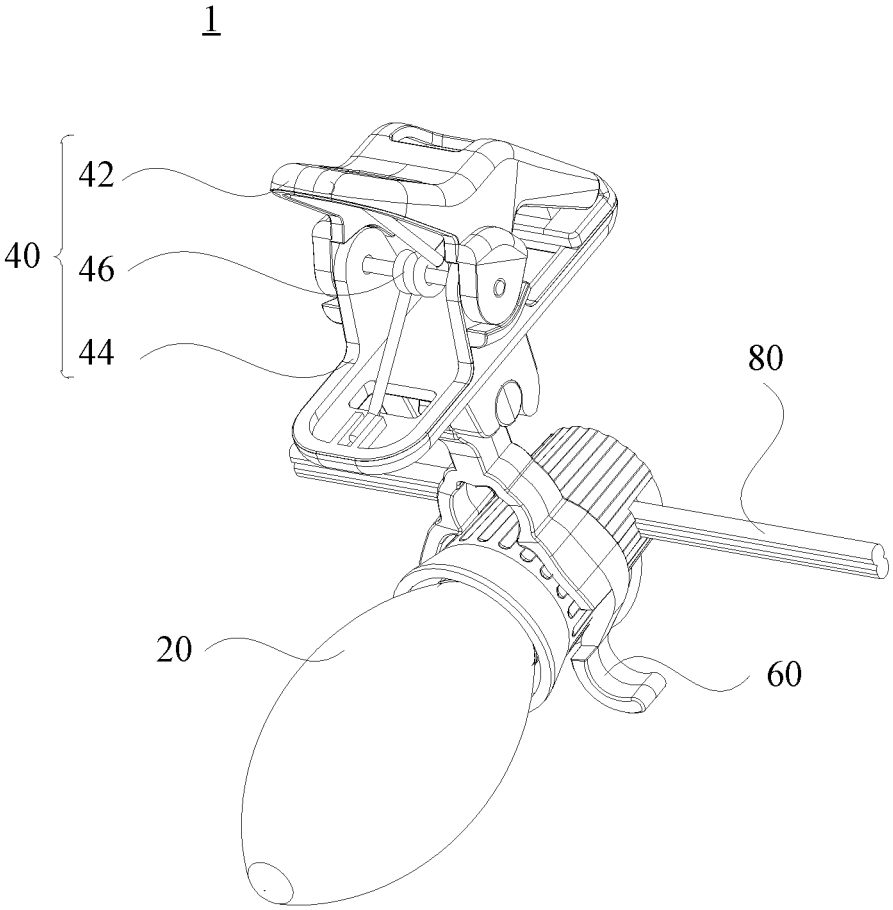
FIG. 9 is a second structural schematic diagram of the lamp according to one embodiment of the present disclosure.
Figure 10:
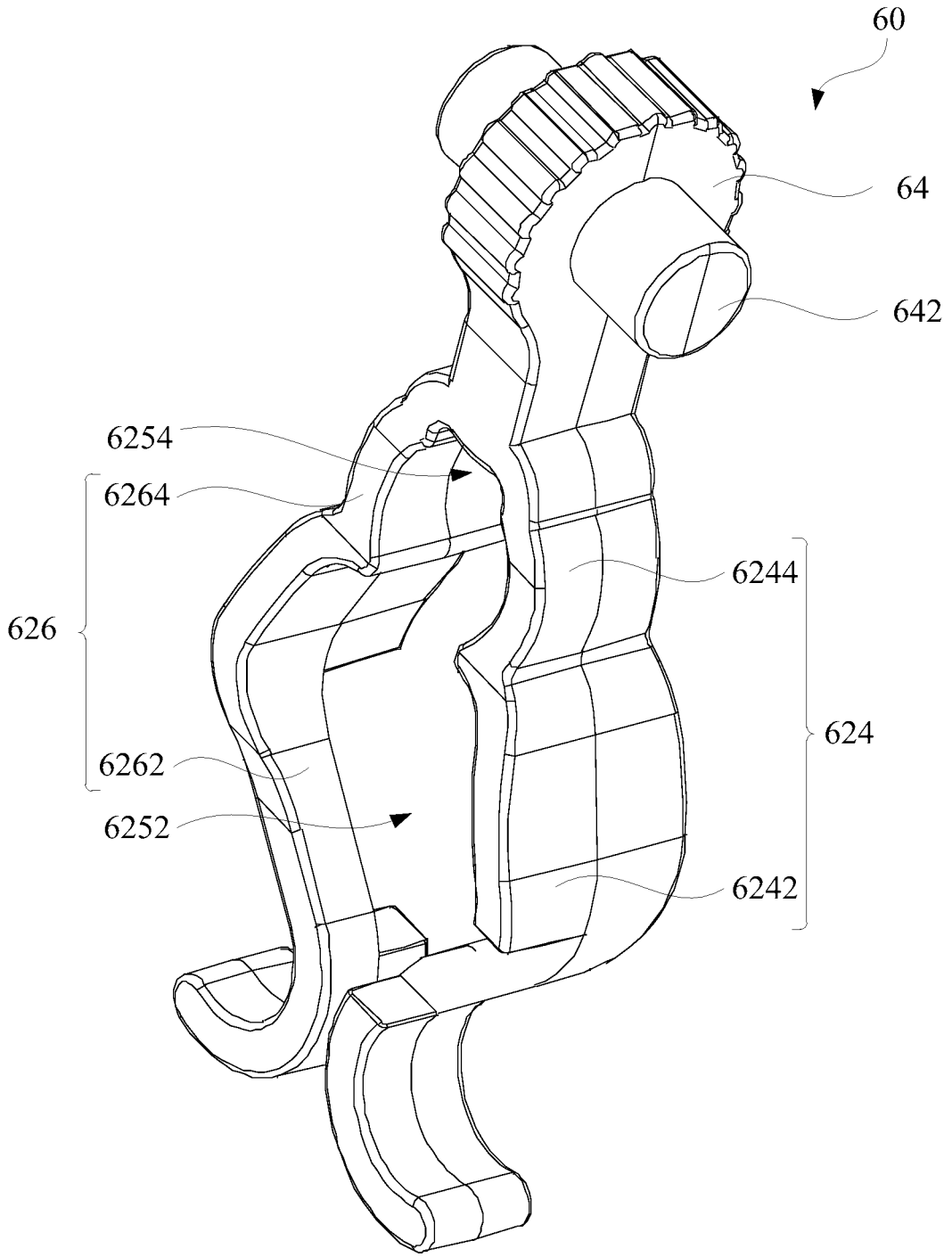
FIG. 10 is a structural schematic diagram of the fixing mechanism in the lamp shown in FIG. 9.

It is understood that the fixing mechanism is further other structures. For example, refer to FIG. 9 and FIG. 10. FIG. 9 is a second structural schematic diagram of the lamp according to one embodiment of the present disclosure. FIG. 10 is a structural schematic diagram of the fixing mechanism in the lamp shown in FIG. 9. The clamping portion 62 includes a first clamping arm 624 and a second clamping arm 626. The first clamping arm 624 and the second clamping arm 626 are oppositely disposed. The first clamping arm 624 includes a first arc-shaped structure 6242. The first arc-shaped structure 6242 is bent along a direction distal from the second clamping arm 626. The second clamping arm 626 includes a second arc-shaped structure 6262. The second arc-shaped structure 6262 is bent along a direction distal from the first clamping arm 624. The first arc-shaped structure 6242 and the second arc-shaped structure 6262 surround to form a first clamping space 6252. A shape of the lamp body 20 is adapted to the first clamping space 6252. The first arc-shaped structure 6242 and the second arc-shaped structure 6262 conveniently clamp the lamp body 20. It should be noted that the first arc-shaped structure 6242 and the second arc-shaped structure 6262 only clamp two opposite sides of the lamp body 20 and fix the lamp body 20 from the two sides of the lamp body 20, and the first arc-shaped structure 6242 and the second arc-shaped structure 6262 do not need to be wound around the lamp body 20.

Figure 11:
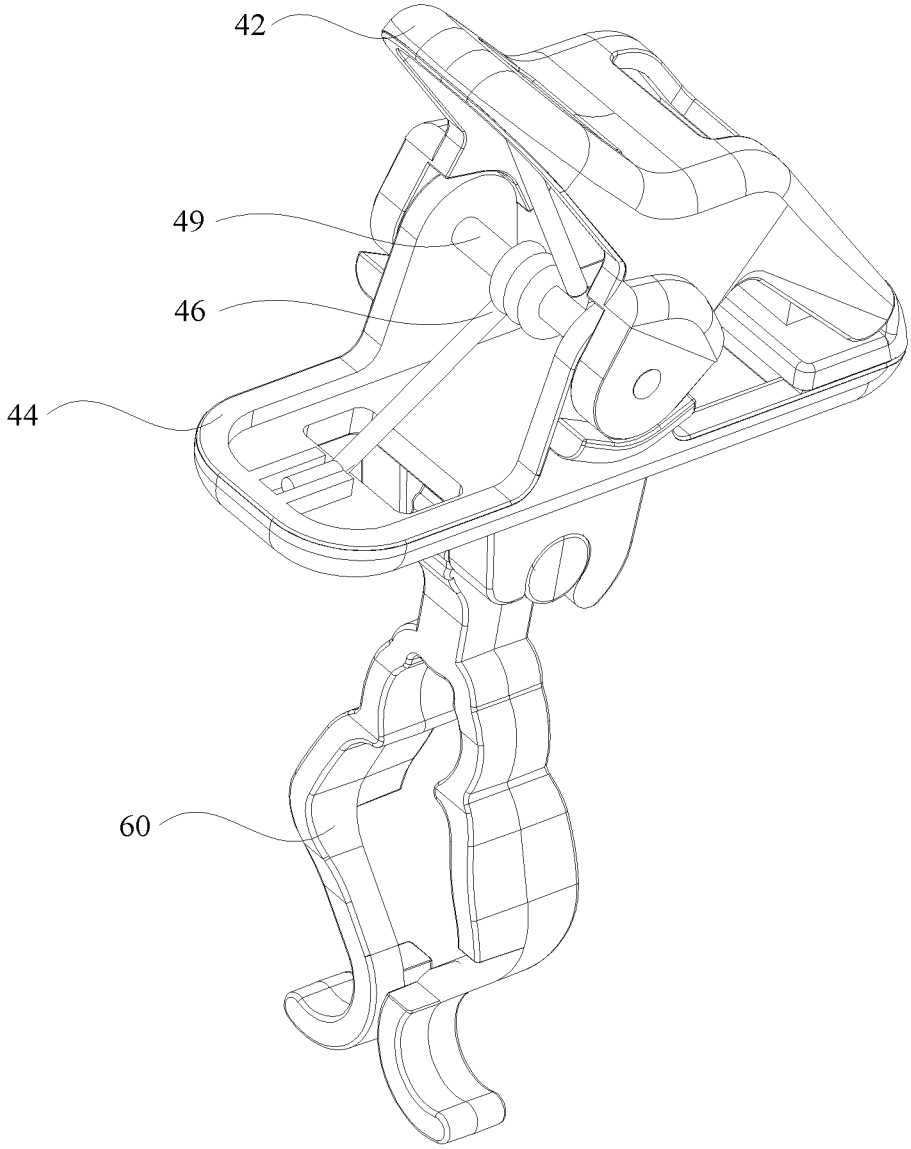
FIG. 11 is a structural schematic diagram of the clamping mechanism and the fixing mechanism in the lamp shown in FIG. 9.
Figure 12:
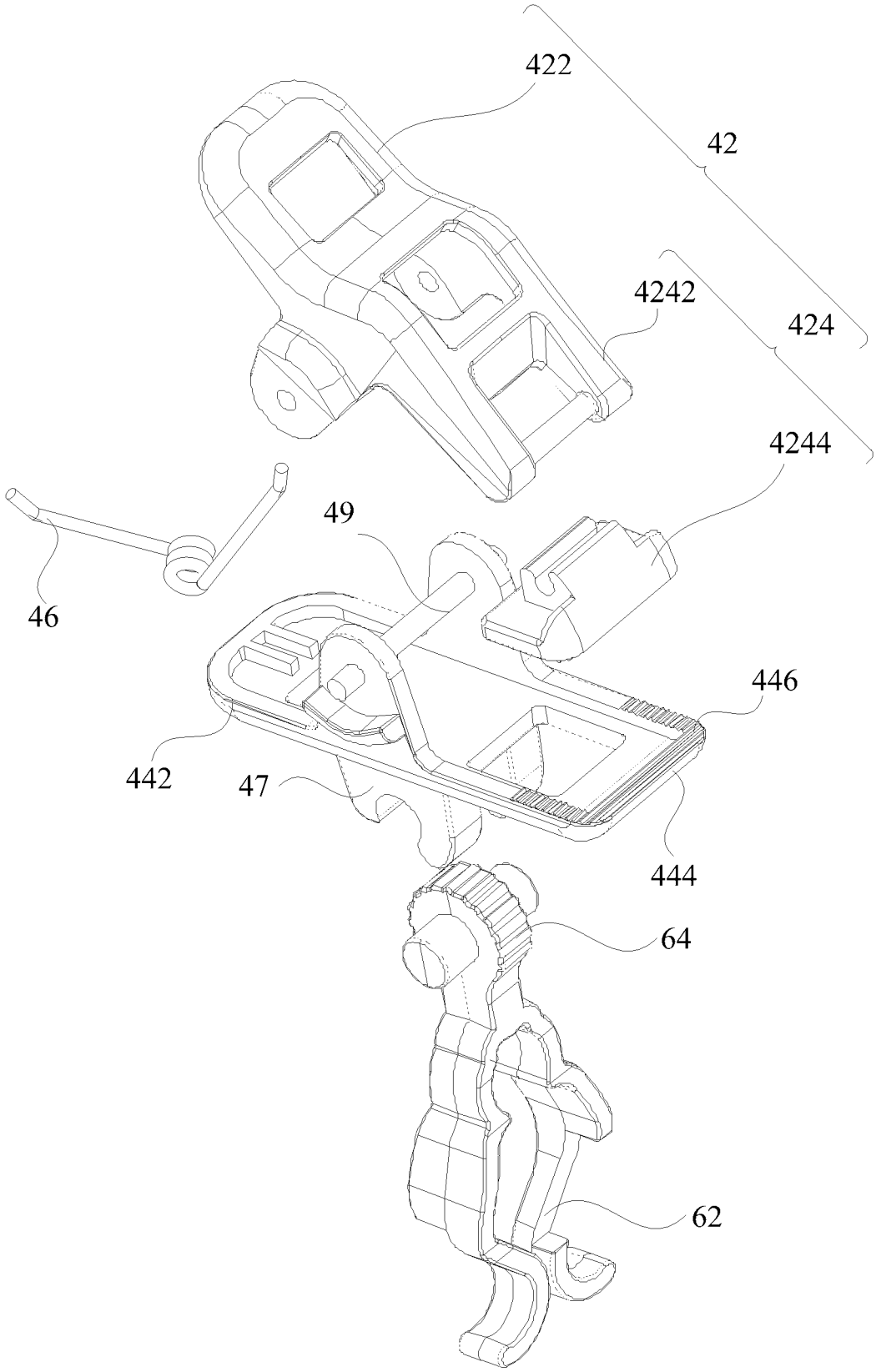
FIG. 12 is an exploded schematic diagram of the clamping mechanism and the fixing structure shown in FIG. 11.

Referring to FIG. 11 and FIG. 12, FIG. 11 is a structural schematic diagram of the clamping mechanism and the fixing mechanism in the lamp shown in FIG. 9. FIG. 12 is an exploded schematic diagram of the clamping mechanism and the fixing structure shown in FIG. 11. A clamping structure of the lamp in the embodiment is the clamping mechanism in any one of the above embodiments, and details are not described herein again. A fixing structure in the embodiment further includes the gear, which is configured to be connected to the clamping mechanism.

Figure 13:
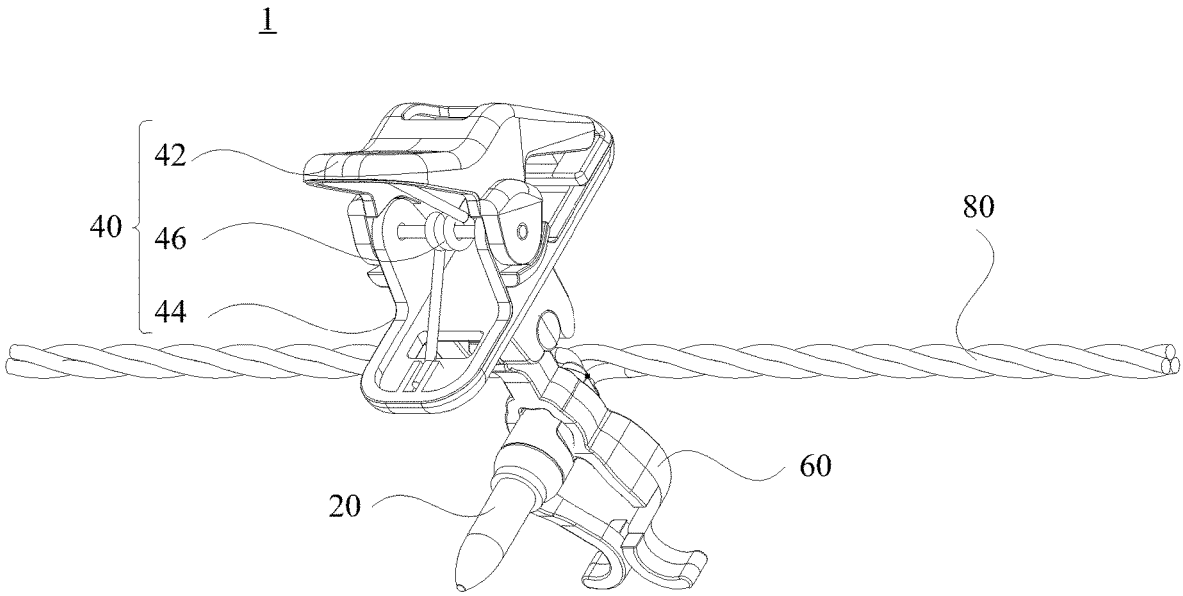
FIG. 13 is a third structural schematic diagram of the lamp according to one embodiment of the present disclosure.

Optionally, referring to FIG. 13, FIG. 13 is a third structural schematic diagram of the lamp according to one embodiment of the present disclosure. The lamp in the embodiment mainly differs from the lamp shown in FIG. 9 in that the lamp body is different, and the clamping structure and the fixing mechanism adopt a same structure. Please continue to refer to FIG. 10, the first clamping arm 624 further includes a third arc-shaped structure 6244. The third arc-shaped structure 6244 is bent along a direction distal from the second clamping arm 626. The second clamping arm 626 includes a fourth arc-shaped structure 6264. The fourth arc-shaped structure 6264 is bent along a direction distal from the first clamping arm 624. The third arc-shaped structure 6244 and the fourth arc-shaped structure 6264 surround to form a second clamping space 6254. The first clamping arm 624 and the second clamping arm 626 form two clamping spaces, thus clamping two lamp bodies 20, which met requirements of the users.

Optionally, sizes of the two clamping spaces are the same, thus clamping the two lamp bodies 20 with a same size, and improving brightness of a lamp string. In addition, the two lamp bodies 20 having the same size may be two lamp bodies 20 having the same color, and may further be two lamp bodies 20 having different colors.

Optionally, the sizes of the two clamping spaces may further be different. For example, the second clamping space 6254 is smaller than the first clamping space 6252. The first clamping arm 624 and the second clamping arm 626 form the two clamping spaces, moreover, the two clamping spaces are different in size. When using the device, the users choose one of the lamp bodies 20 having two different sizes according to needs. Of course, the users may further clamp the lamp bodies 20 having the two different sizes at the same time.

Figure 14:
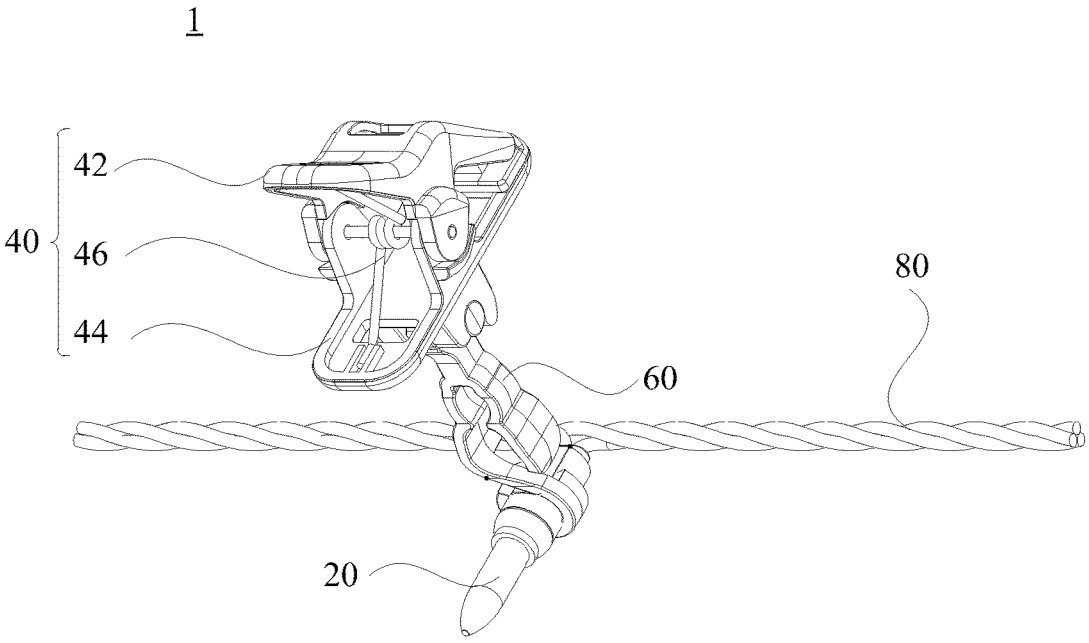
FIG. 14 is a fourth structural schematic diagram of the lamp according to one embodiment of the present disclosure.
Figure 15:
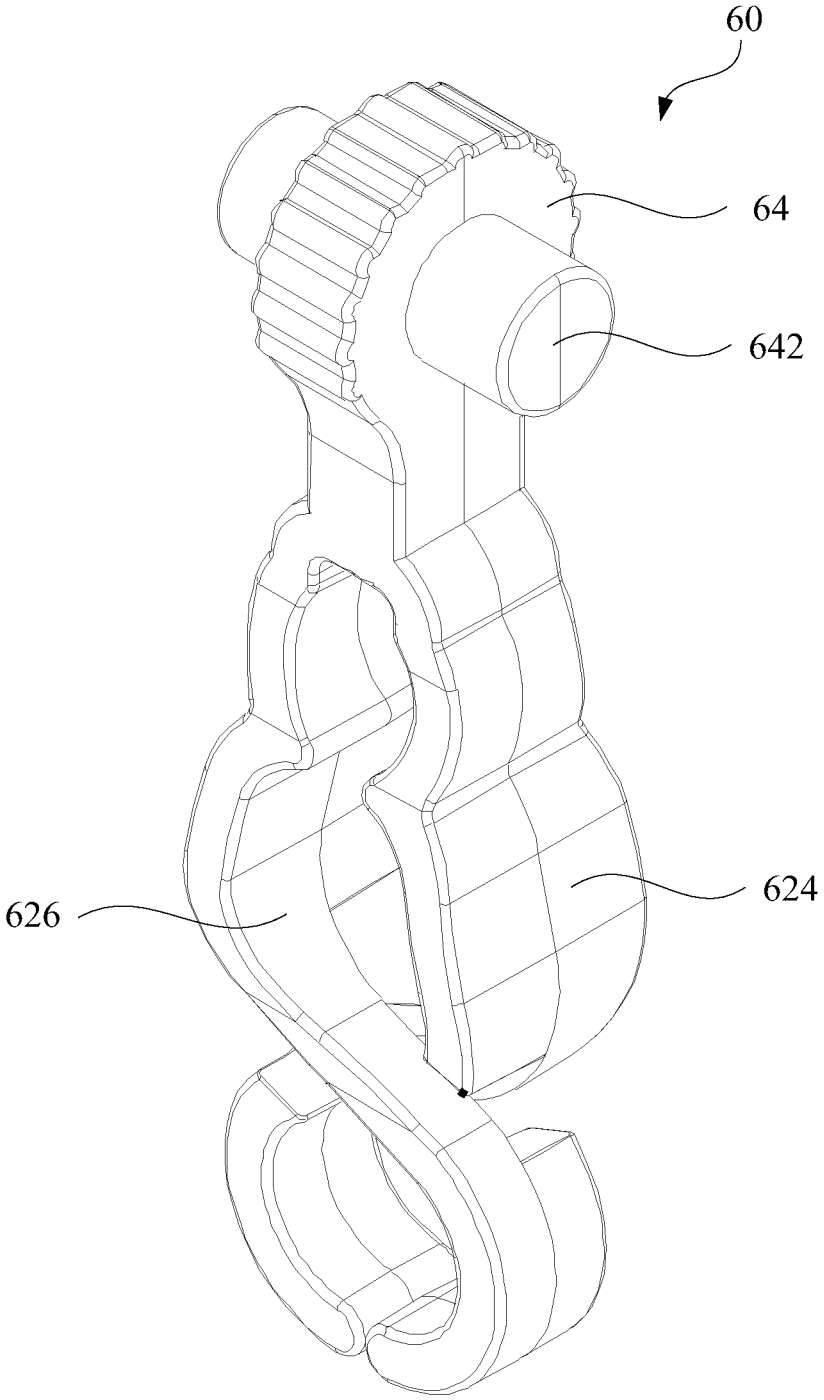
FIG. 15 is a structural schematic diagram of the fixing mechanism in the lamp shown in FIG. 14.

It is understood that in some embodiments, the first clamping arm 624 and the second clamping arm 626 may further form three or more clamping spaces, and sizes of any two of the clamping spaces are different, thereby the lamp bodies 20 having three or more sizes are clamped. In some other embodiments, the fixing mechanism further adopts other structures to form a plurality of clamping spaces. Referring to FIG. 14 and FIG. 15, FIG. 14 is a fourth structural schematic diagram of the lamp according to one embodiment of the present disclosure. FIG. 15 is a structural schematic diagram of the fixing mechanism in the lamp shown in FIG. 14. The first clamping arm 624 and the second clamping arm 626 form three clamping spaces having different sizes.

A first end, close to the clamping mechanism 40, of the first clamping arm 624 is connected to a first end, close to the clamping mechanism 40, of the second clamping arm 626. A second end, distal from the clamping mechanism 40, of the first clamping arm 624 is separated from a second end, distal from the clamping mechanism 40, of the second clamping arm 626.

The first ends, close the clamping mechanism 40, of the first clamping arm 624 and the second clamping arm 626 are connected. The second ends, distal from the clamping mechanism 40, of the first clamping arm 624 and the second clamping arm 626 are separated. Therefore, a good clamping force is provided for the first clamping arm 624 and the second clamping arm 626, and the first clamping arm 624 and the second clamping arm 626 are further conveniently opened so as to be placed in the lamp body 20.

Optionally, a first notch is defined in a middle of the first clamping arm, and a second notch is formed in a middle of the second clamping arm. The first clamping arm and the second clamping arm are oppositely disposed, which reduces use of raw materials, reduces production cost, and does not influence use of the first clamping arm and the second clamping arm.

Optionally, the first clamping plate 42 and the second clamping plate 44 are connected through a connecting shaft 49. The first clamp plate 42 and the second clamp plate 44 rotate with respect to each other through the connecting shaft 49. The elastic component 46 is a torsion spring. The elastic component 46 is sleeved on the connecting shaft 49. The elastic component 46 includes two abutting ends. The two abutting ends respectively abut against the first clamping plate 42 and the second clamping plate 44. In order to prevent the abutting ends of the elastic component 46 from sliding and ensure that the first clamping plate 42 and the second clamping plate 44 are normally used, limiting grooves are defined on both of the first clamping plate 42 and the second clamping plate 44, and positions of the abutting ends of the elastic component 46 are limited.

It is understood that the lamp 1 includes a plurality of the lamp bodies 20, a plurality of the clamping mechanisms 40, and a plurality of the fixing mechanisms 60. The plurality of the lamp bodies 20 are connected through the wires 80. The plurality of the clamping mechanisms 40 and the plurality of the fixing mechanisms 60 are disposed in one-to-one correspondence. Each of the plurality of the lamp bodies 20 is disposed on one of the plurality of the fixing mechanisms 60. For example, the lamp 1 includes a lamp string formed by the plurality of the lamp bodies 20, and the fixing mechanisms 60 and the clamping mechanisms 40 connected to each of the plurality of the lamp bodies 20 in the lamp string, so that each of the lamp bodies 20 of the lamp string is disposed at a proper position. The plurality of the clamping mechanisms 40 are used together, which realizes outdoor rapid installation of the lamp string, and the users do not need to spend a lot of energy to install the lamp string.

For example, the plurality of the lamp bodies 20 include a string of lamps formed by Christmas lamps, Halloween lamps, garden lamps, or other decorative festival lamps. The lamp string is reliably attached onto the objects to-be-clamped through the fixing mechanism 60 and the clamping mechanism 40 and is also convenient for separating from the objects to-be-clamped. The objects to-be-clamped ,may be trees, ornamental shrubs, eaves, roof edges of houses, or other objects. Due to a fact that the clamping mechanism 40 is rapidly and conveniently clamped to the objects to-be-clamped, and clamping firmness is better, compared with prior art, the present disclosure has less time consumption and better stability. In addition, when clamping on ladders or other elevated platforms, especially in cold, wet or icy environments, because of good clamping effect and fast speed, it is completed faster and better, and is not easy to cause danger.

The present disclosure further provides a lamp fixing device. Referring to FIGS. 1-15, the lamp fixing device includes a clamping mechanism 40 and a fixing mechanism 60. The clamping mechanism 40 is connected with the fixing mechanism 60. The fixing mechanism 60 is configured to install a lamp body. The clamping mechanism 40 includes a first clamping plate 42, a second clamping plate 44, and an elastic component 46. The first clamping plate 42 includes a first pressing portion 422 and a first clamping portion 424. The first pressing portion 422 is connected with the first clamping portion 424. The second clamping plate 44 is hinged to the first clamping plate 42. The second clamping plate 44 includes a second pressing portion 442 and a second clamping portion 444. The second pressing portion 442 is connected with the second clamping portion 444. The elastic component 46 is disposed between the first pressing portion 422 and the second pressing portion 442, so that the first clamping portion 424 is close to the second clamping portion 444. The first clamping portion 424 includes a connecting structure 4242 and a turning sheet 4244. The connecting structure 4242 is connected to the first pressing portion 422. The turning sheet 4244 is rotatably connected to the connecting structure 4242. The turning sheet 4244 and the second clamping portion 444 are configured to clamp objects to-be-clamped.

It is understood that specific structures, connection relationships, and functional effects of the first clamping plate 42, the second clamping plate 44, and the elastic component 46 in the present embodiment refer to the clamping portion 62 in the above embodiments, and details are not described herein again.

In some examples, the fixing mechanism 60 includes a clamping part 62, the lamp body 20 is clamped to the clamping part 62, the clamping part 62 is rotatably connected with the clamping mechanism 40 and can be fixedly kept at different angles with the clamping mechanism 40.

In some examples, the fixing mechanism 60 includes a clamping portion 62. The lamp body 20 is clamped to the clamping portion 62. The clamping portion 62 is rotatably connected to the clamping mechanism 40 and is fixedly kept at different angles with the clamping mechanism 40.

It is understood that a specific structure, a connection relationship, and a functional effect of the clamping portion in the embodiment refer to the clamping portion in the above embodiments, and details are not repeated here.

The lamp and the lamp fixing device provided by the embodiments of the present disclosure are described in detail above. In the present disclosure, specific examples are configured to explain principle and implementation mode of the present disclosure. Above description of embodiments is only configured to help understand a method and core idea of the present disclosure. Meanwhile, for a person skilled in the art, according to the idea of the present disclosure, there are changes in the specific implementation mode and application scope. In conclusion, contents of specification should not be understood as limitation on the present disclosure.

What is claimed is:

1. A lamp, comprising:

at least one lamp body; and at least one clamping mechanism;

wherein the at least one lamp body is connected to the at least one clamping mechanism, and the at least one clamping mechanism comprises:

a first clamping plate;

a second clamping plate; and an elastic component;

the first clamping plate comprises a first pressing portion and a first clamping portion, the first pressing portion is connected with the first clamping portion;

the second clamping plate is hinged to the first clamping plate, the second clamping plate comprises a second pressing portion and a second clamping portion, and the second pressing portion is connected with the second clamping portion;

the elastic component is disposed between the first pressing portion and the second pressing portion, so that the first clamping portion is close to the second clamping portion;

the first clamping portion comprises a connecting structure and a turning sheet, the connecting structure is connected to the first pressing portion, the turning sheet is rotatably connected to the connecting structure, and the turning sheet and the second clamping portion are configured to clamp objects to-be-clamped;

wherein the lamp further comprises at least one fixing mechanism, the fixing mechanism is connected to the at least one clamping mechanism, the at least one fixing mechanism comprises a clamping portion, and the at least one lamp body is clamped to the clamping portion.

2. The lamp according to claim 1, wherein a rotating shaft is disposed at one end, distal from the first pressing portion, of the connecting structure; the turning sheet comprises a clamping slot, and the rotating shaft is clamped in the clamping slot, so that the turning sheet rotates around the rotating shaft.

3. The lamp according to claim 2, wherein the clamping slot comprises a first opening, the rotating shaft is clamped in the clamping slot through the first opening, and a size of the first opening is smaller than a diameter of the rotating shaft.

4. The lamp according to claim 1, wherein the turning sheet comprises a first clamping side, the first clamping side is clamped and matched with the second clamping portion, and a first anti-skid structure is disposed on the first clamping side.

5. The lamp according to claim 4, wherein the first anti-skid structure comprises a plurality of anti-skid strips, and the plurality of the anti-skid strips are uniformly distributed on the first clamping side.

6. The lamp according to claim 1, wherein the second clamping portion comprises a second clamping side facing the first clamping portion, and a second anti-skid structure is disposed on the second clamping side.

7. The lamp according to claim 6, wherein the second clamping side comprises an end edge distal from the second pressing portion and two side edges connected with the end edge, the two side edges are oppositely disposed and are connected to two ends of the end edge, and the second anti-skid structure is disposed on the end edge and the two side edges.

8. The lamp according to claim 1, wherein the clamping portion is rotatably connected to the at least one clamping mechanism, and the clamping portion is fixedly kept at different angles with the at least one clamping mechanism.

9. The lamp according to claim 8, wherein two protruding portions are disposed on one side, facing the at least one fixing mechanism, of the at least one clamping mechanism; the two protruding portions are disposed at intervals, clamping grooves are defined on the two protruding portions, a positioning portion is disposed in an area, located between the two protruding portions, of the at least one clamping mechanism;

the at least one fixing mechanism comprises a gear, convex columns are respectively disposed on two opposite side edges of the gear, each of the convex columns is clamped in a respective one of the clamping grooves, and the gear is matched with the positioning portion to be positioned at different angles.

10. The lamp according to claim 1, wherein the clamping portion comprises a hollow accommodating space, the clamping portion comprises an annular wall, the annular wall surrounds to form the hollow accommodating space, a second opening is defined on one side of the annular wall, the second opening is communicated with the hollow accommodating space, the at least one lamp body enters the hollow accommodating space through the second opening, and the at least one lamp body is clamped to the annular wall.

11. The lamp according to claim 10, wherein the at least one lamp body comprises a main body portion and a hook, the main body portion is connected with the hook, the main body portion is disposed in the hollow accommodating space, and the hook is hung on the annular wall.

12. The lamp according to claim 10, wherein the at least one fixing mechanism further comprises a wire accommodating groove, and the wire accommodating groove is configured to accommodate a wire connected to the at least one lamp body.

13. The lamp according to claim 12, wherein the wire accommodating groove is defined between the clamping portion and the at least one clamping mechanism.

14. The lamp according to claim 1, wherein the clamping portion comprises a first clamping arm and a second clamping arm; the first clamping arm and the second clamping arm are oppositely disposed, the first clamping arm comprises a first arc-shaped structure, the first arc-shaped structure is bent along a direction distal from the second clamping arm; the second clamping arm comprises a second arc-shaped structure, the second arc-shaped structure is bent along a direction distal from the first clamping arm; and the first arc-shaped structure and the second arc-shaped structure surround to form a first clamping space.

15. The lamp according to claim 14, wherein the first clamping arm further comprises a third arc-shaped structure, the third arc-shaped structure is bent along a direction distal from the second clamping arm, the second clamping arm comprises a fourth arc-shaped structure, the fourth arc-shaped structure is bent along a direction distal from the first clamping arm, the third arc-shaped structure and the fourth arc-shaped structure surround to form a second clamping space, and the second clamping space is smaller than the first clamping space.

16. The lamp according to claim 14, wherein a first end, close to the at least one clamping mechanism, of the first clamping arm is connected to a first end, close to the at least one clamping mechanism, of the second clamping arm; and a second end, distal from the at least one clamping mechanism, of the first clamping arm is separated from a second end, distal from the at least one clamping mechanism, of the second clamping arm.

17. The lamp according to claim 1, wherein the lamp comprises a plurality of lamp bodies, a plurality of clamping mechanisms, and a plurality of fixing mechanisms, the plurality of the lamp bodies are connected through wires, the plurality of the clamping mechanisms and the plurality of the fixing mechanisms are disposed in one-to-one correspondence, and each of the plurality of the lamp bodies is disposed on one of the plurality of the fixing mechanisms.

18. A lamp fixing device, comprising:

a clamping mechanism; and a fixing mechanism;

wherein the clamping mechanism is connected with the fixing mechanism; the fixing mechanism is configured to install a lamp body; the clamping mechanism comprises a first clamping plate, a second clamping plate, and an elastic component;

the first clamping plate comprises a first pressing portion and a first clamping portion, and the first pressing portion is connected with the first clamping portion;

the second clamping plate is hinged to the first clamping plate, the second clamping plate comprises a second pressing portion and a second clamping portion, the second pressing portion is connected with the second clamping portion;

the elastic component is disposed between the first pressing portion and the second pressing portion, so that the first clamping portion is close to the second clamping portion;

the first clamping portion comprises a connecting structure and a turning sheet, the connecting structure is connected to the first pressing portion, the turning sheet is rotatably connected to the connecting structure, and the turning sheet and the second clamping portion are configured to clamp objects to-be-clamped: and wherein the fixing mechanism comprises a clamping portion, the lamp body is clamped to the clamping portion, and the clamping portion is rotatably connected to the clamping mechanism and is fixedly kept at different angles with the clamping mechanism.

19. A lamp, comprising:

at least one lamp body; and at least one clamping mechanism;

wherein the at least one lamp body is connected to the at least one clamping mechanism, and the at least one clamping mechanism comprises:

a first clamping plate;

a second clamping plate; and an elastic component;

the first clamping plate comprises a first pressing portion and a first clamping portion, the first pressing portion is connected with the first clamping portion;

the second clamping plate is hinged to the first clamping plate, the second clamping plate comprises a second pressing portion and a second clamping portion, and the second pressing portion is connected with the second clamping portion;

the elastic component is disposed between the first pressing portion and the second pressing portion, so that the first clamping portion is close to the second clamping portion;

the first clamping portion comprises a connecting structure and a turning sheet, the connecting structure is connected to the first pressing portion, the turning sheet is rotatably connected to the connecting structure, and the turning sheet and the second clamping portion are configured to clamp objects to-be-clamped;

wherein a rotating shaft is disposed at one end, distal from the first pressing portion, of the connecting structure; the turning sheet comprises a clamping slot, and the rotating shaft is clamped in the clamping slot, so that the turning sheet rotates around the rotating shaft;

wherein the clamping slot comprises a first opening, the rotating shaft is clamped in the clamping slot through the first opening, and a size of the first opening is smaller than a diameter of the rotating shaft.

20. The lamp according to claim 19, wherein the turning sheet comprises a first clamping side, the first clamping side is clamped and matched with the second clamping portion, and a first anti-skid structure is disposed on the first clamping side.

* * * * *